US011547190B2

(12) United States Patent
DeVeaux

(10) Patent No.: US 11,547,190 B2
(45) Date of Patent: Jan. 10, 2023

(54) WHEELED BAG WITH EXTENDABLE SUPPORT PLATFORM

(71) Applicant: Eric A. DeVeaux, Philadelphia, PA (US)

(72) Inventor: Eric A. DeVeaux, Philadelphia, PA (US)

( * ) Notice: Subject to any disclaimer, the term of this patent is extended or adjusted under 35 U.S.C. 154(b) by 335 days.

(21) Appl. No.: 16/751,142

(22) Filed: Jan. 23, 2020

(65) Prior Publication Data

US 2021/0076791 A1 Mar. 18, 2021

Related U.S. Application Data

(60) Provisional application No. 62/899,709, filed on Sep. 12, 2019.

(51) Int. Cl.

| | |
|---|---|
| ***A45C 9/00*** | (2006.01) |
| ***A45C 13/26*** | (2006.01) |
| ***A45C 13/28*** | (2006.01) |
| ***A47B 3/10*** | (2006.01) |
| ***A47B 9/20*** | (2006.01) |
| ***A47B 13/08*** | (2006.01) |
| ***A47B 5/04*** | (2006.01) |

(52) U.S. Cl.

CPC ..... *A45C 9/00* (2013.01); *A45C 13/262* (2013.01); *A45C 13/28* (2013.01); *A47B 3/10* (2013.01); *A47B 5/04* (2013.01); *A47B 9/20* (2013.01); *A47B 13/081* (2013.01); *A45C 2009/002* (2013.01); *A45C 2013/267* (2013.01)

(58) Field of Classification Search

CPC ..... A45C 9/00; A45C 13/262; A45C 13/28; A45C 2009/002; A45C 2013/267; A47B 3/10; A47B 5/04; A47B 9/20; A47B 13/081

See application file for complete search history.

(56) References Cited

U.S. PATENT DOCUMENTS

| | | | | |
|---|---|---|---|---|
| 2,603,500 | A * | 7/1952 | Messier | A47B 31/00 280/30 |
| 5,069,142 | A * | 12/1991 | Matre | A47B 3/02 108/115 |
| 5,437,367 | A | 8/1995 | Martin | |
| 5,941,352 | A | 8/1999 | Lee | |
| 6,439,134 | B1 | 8/2002 | Ryburg | |
| 6,471,019 | B1 | 10/2002 | Miller | |
| 6,578,708 | B2 | 6/2003 | Barnett | |
| 6,796,319 | B1 * | 9/2004 | Patarra | A45C 11/20 108/138 |
| 7,481,070 | B2 * | 1/2009 | Costanzo | F25B 27/005 62/235.1 |

(Continued)

*Primary Examiner* — Tri M Mai

(74) *Attorney, Agent, or Firm* — LaMorte & Associates, PC

(57) ABSTRACT

A travel bag assembly that utilizes a bag construct with a top surface. A retractable pull handle is provided. A depression is formed in the top surface of the bag construct. A support platform is provided that either directly fits into the depression or can be folded to fit in the depression. The support platform is connected to the bag construct by at least one adjustable shaft. The adjustable shaft enables the support platform to be selectively adjusted in elevation throughout a range above top surface of the bag construct without effecting the retractable pull handle.

13 Claims, 5 Drawing Sheets

(56) References Cited

U.S. PATENT DOCUMENTS

| | | | | |
|---|---|---|---|---|
| 9,157,567 | B1 | 10/2015 | Calabrese | |
| 9,498,055 | B2 | 11/2016 | Distefano | |
| 2005/0098402 | A1 | 5/2005 | Cohen | |
| 2007/0159781 | A1 | 7/2007 | Zbikowski | |
| 2010/0187062 | A1 | 7/2010 | Sweeney et al. | |
| 2012/0325607 | A1* | 12/2012 | Webster | A45C 15/00<br>280/30 |
| 2016/0045009 | A1* | 2/2016 | Hansborough | A45C 13/28<br>190/11 |
| 2021/0000230 | A1* | 1/2021 | Libuda | A45C 5/14 |

* cited by examiner

WHEELED BAG WITH EXTENDABLE SUPPORT PLATFORM

RELATED APPLICATIONS

This application claims the benefit of U.S. Provisional Patent Application No. 62/899,709, filed Sep. 12, 2019.

BACKGROUND OF THE INVENTION

1. Field of the Invention

In general, the present invention relates to the structure of wheeled travel bags that are commonly used as suitcases or briefcases. More particularly, the present invention relates to wheeled travel bags that have some type of extendable platform incorporated into their designs that enables the bag to act as a table or similar support.

2. Prior Art Description

Many people travel with wheeled bags. The use of a wheeled bag eliminates the need for a person to lift the full weight of the bag. Rather, the bag can be simply pulled on its wheels as the person travels. Most wheeled bags have adjustable handles that can be extended when the wheeled bag needs to be pulled. In this manner, the handle can be retracted when the wheeled bag is loaded onto an airplane or into a car.

Wheeled bags are commonly used when a person travels. As such, the wheeled bag accompanies a traveler in airports, train terminals and the like. Many people who travel also travel with laptop computers and similar devices that allow the travelers to perform computer related tasks while traveling. In airports and other waiting stations, a traveler often cannot find an adequate work surface for the laptop computer. As a result, the traveler typically uses his/her lap and knees as support or tries to place the laptop upon the wheeled bag. Most wheeled bags have curved surfaces, handles, and other features that make it difficult to balance a laptop upon the wheeled bag. This causes the traveler to secure the laptop with one hand while operating the laptop with the other.

In an attempt to provide a better working surface, wheeled bags have been produced that have a folding platform attached to the pull handle of the wheeled bag. Such prior art rolling bags are exemplified by U.S. Patent Application Publication No. 2010/0187062 to Sweeney and U.S. Pat. No. 5,437,367 to Martin. However, such prior art platforms are attached to the pull handle of the wheeled bag, which creates one of two problems. If the platform is attached to the pull handle below the top of the pull handle, as in the Sweeney publication, then the platform and the pull handle meet at a right angle. When a laptop is placed on the platform, the screen of the laptop cannot be rotated beyond 90 degrees, due to the presence of the handle. As a consequence, the laptop cannot be fully opened and the screen of the laptop becomes difficult to see from many angles. Alternatively, if the platform is positioned at the top of the pull handle, as in the Martin Patent, then the pull handle cannot be grasped while the laptop is in place. As such, the laptop must be lifted off the platform in order to grasp the handle and adjust the position of the wheeled bag.

Another disadvantage of prior art platforms on wheeled bags is that the platforms typically fold away into the interior of the bag. As such, the presence of the retracted platform reduces the space available in the bag. Additionally, the platform serves no useful function when retracted. In many prior art designs, the bag needs to be partially emptied, unfolded and/or otherwise opened in order to access the retracted support platform. This is highly inconvenient, especially if the bag is fully loaded for travel and the traveler is in a public place.

A need therefore exists for an improved wheeled bag design that provides a retractable support platform and does not reduce the capacity of the bag when retracted. A need also exists for an improved bag design that has a support platform that does not restrict use of the bag handle when deployed nor limit the configurations of a laptop on the support platform. These needs are met by the present invention as described and claimed below.

SUMMARY OF THE INVENTION

The present invention is a travel bag assembly that utilizes a bag construct. The bag construct has wheels. When resting upon the wheels, the bag construct has a top surface that faces upwardly. A retractable pull handle is provided so that the bag construct can be conveniently pulled or pushed on its wheels.

A depression is formed in the top surface of the bag construct. The depression is an external feature and does not access the interior of the bag construct. A support platform is provided that either directly fits into the depression or can be folded to fit in the depression. The support platform is connected to the bag construct by at least one adjustable shaft. The adjustable shaft enables the support platform to be selectively adjusted in elevation throughout a range above the top surface of the bag construct without effecting the retractable pull handle.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention travel bag assembly can be embodied in many ways, only two exemplary embodiments are illustrated. The two exemplary embodiments are being shown for the purposes of explanation and description. The exemplary embodiments are selected in order to set forth two of the best modes contemplated for the invention. The illustrated embodiments, however, are merely exemplary and should not be considered limitations when interpreting the scope of the appended claims.

Figure 1:
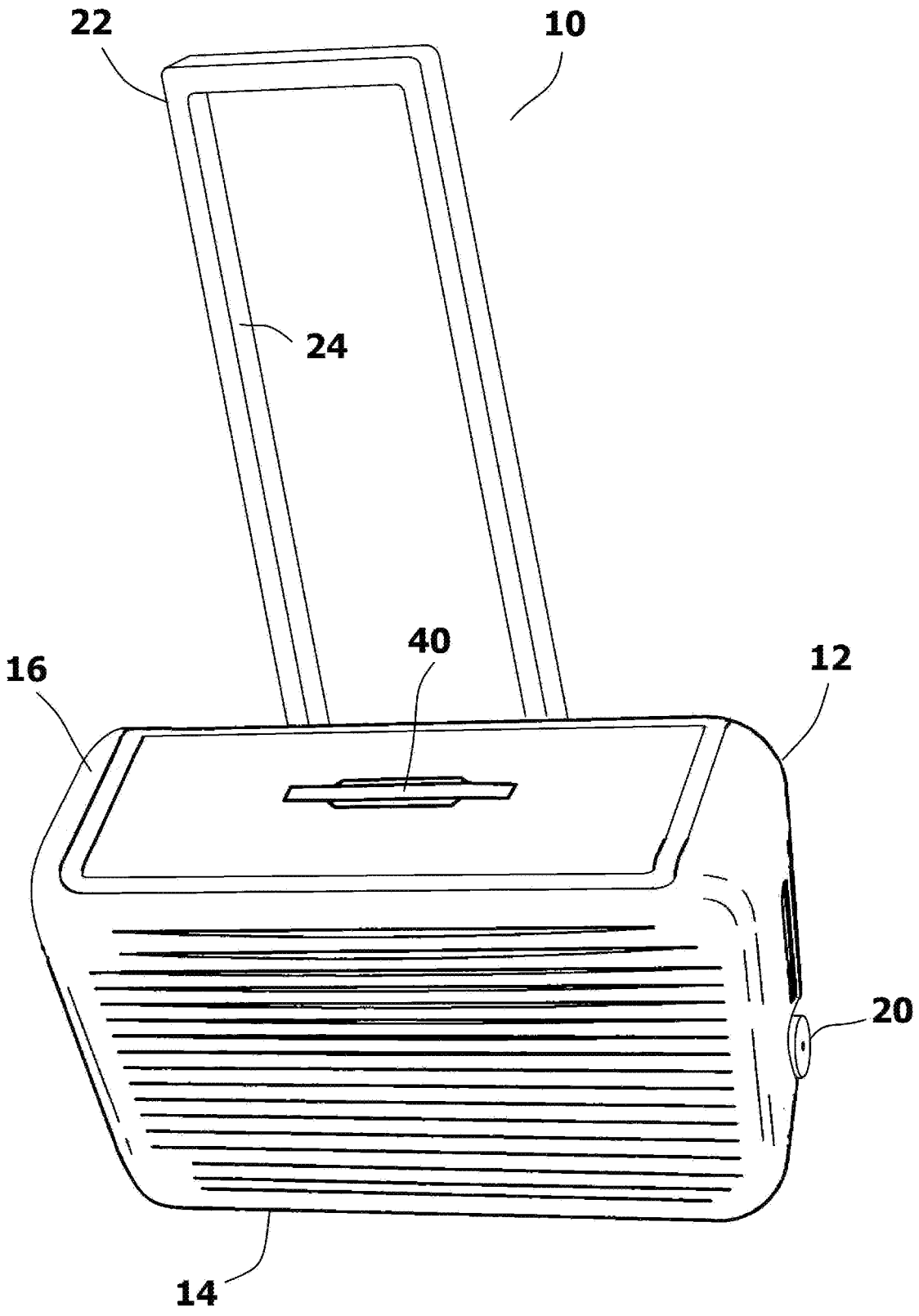
FIG. 1 is a perspective view of an exemplary embodiment of a travel bag assembly with an extended pull handle and a support platform that is both folded and retracted.
Figure 2:
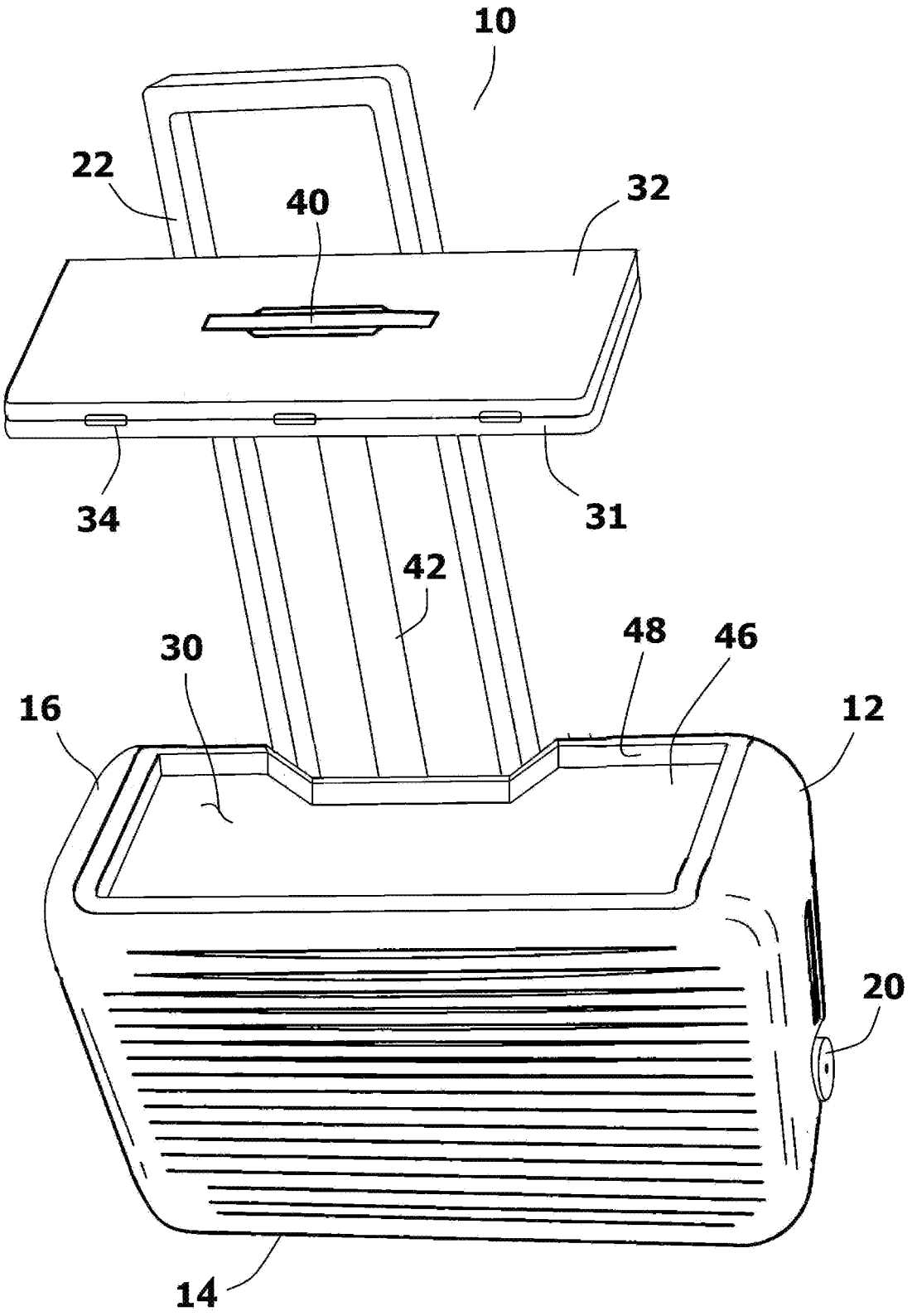
FIG. 2 is a perspective view of an exemplary embodiment of a travel bag assembly with an extended pull handle and a support platform that is extended but folded.

Referring to FIG. 1 and FIG. 2, a travel bag assembly 10 is shown. The travel bag assembly 10 includes a bag construct 12. The bag construct 12 can have many shapes that are a matter of design choice for a manufacturer. Likewise, the bag construct 12 can be any size from the size of a briefcase to the size of a large suitcase. Regardless of the shape and size of the bag construct 12, the bag construct 12 has a bottom surface 14, a top surface 16, and a rear surface 18. The bottom surface 14 faces the ground when the travel bag assembly 10 is resting upon the ground. The top surface 16 faces skyward when the travel bag assembly 10 is resting upon the ground.

Lastly, the rear surface 18 faces the person who is pulling or pushing the travel bag assembly 10. Wheels 20 are attached to the bottom surface 14 and/or are positioned at the junction between the bottom surface 14 and the rear surface 18. In this manner, the bag construct 12 can be rolled with the wheels 20 or tilted onto the wheels 20 when the travel bag assembly 10 is in use. A retractable pull handle 22 is provided to assist in tilting and/or rolling the travel bag assembly 10. The retractable pull handle 22 is a traditional travel bag handle that can be selectively extended from, and retracted into, the bag construct 12. The shown example of the retractable pull handle 22 has two telescoping shafts 24 that extend from the rear surface 18 of the bag construct 12. The retractable pull handle 22 that is illustrated is intended to represent any and all of the many pull handle configurations used on comparable prior art wheeled bags.

A depression 30 is formed in the top surface 16 of the bag construct 12. The depression 30 has a peripheral shape that follows the shape of the bag construct 12. The depression 30 is an external feature of the bag construct 12, in that the depression 30 does not communicate with any compartment within the interior of the bag construct 12.

Figure 3:
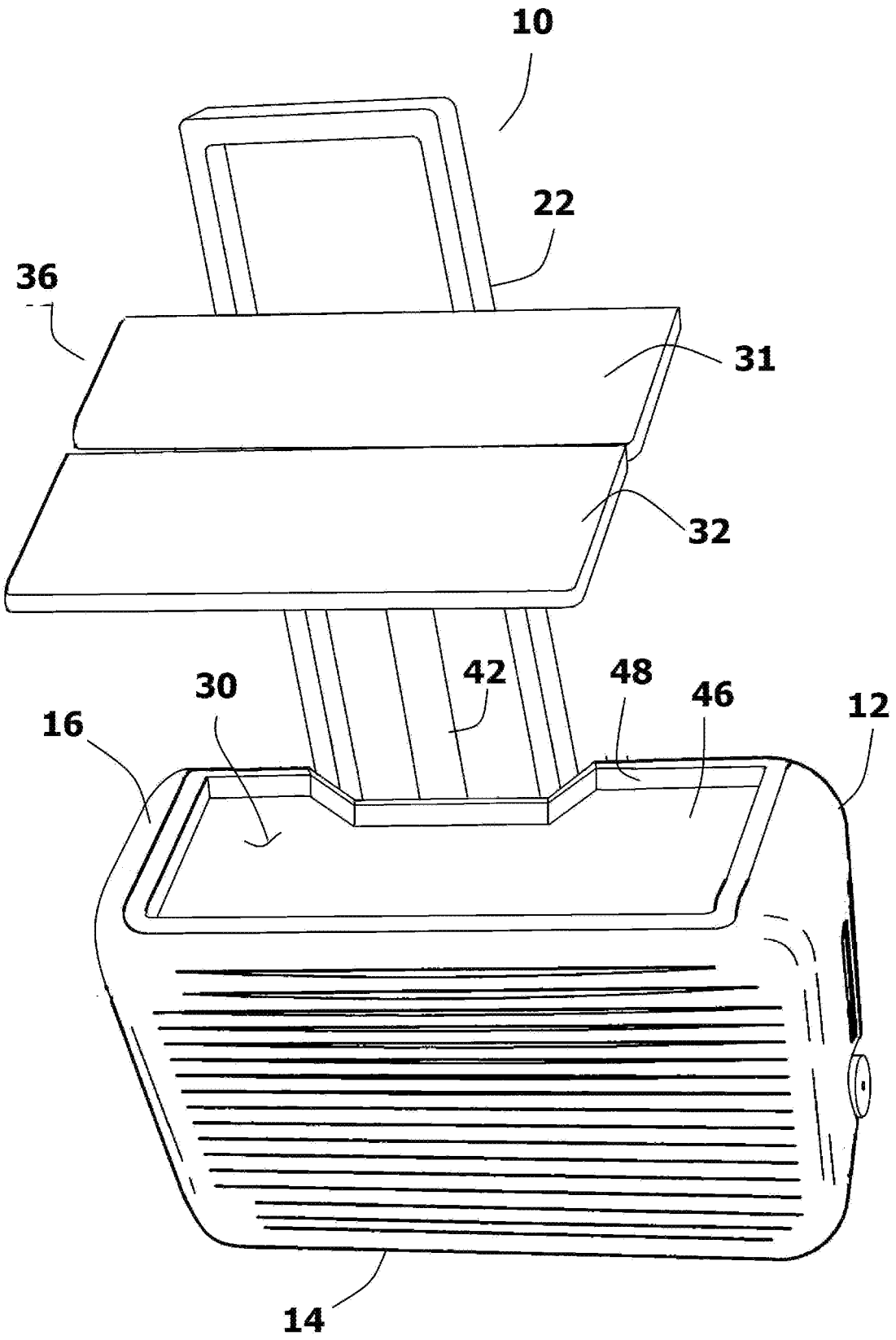
FIG. 3 is a perspective view of an exemplary embodiment of a travel bag assembly with an extended pull handle and a support platform that is both extended and unfolded.

Referring to FIG. 3 in conjunction with FIG. 1 and FIG. 2, it can be seen that two panels 31, 32 are provided. The panels 31, 32 are mirror images of each other. Each panel 31, 32 has a peripheral shape that fits into the depression 30 on the top surface 16 of the bag construct 12. The two panels 31, 32 are joined along a common hinge joint 34. The hinge joint 34 enables the second panel 32 to be selectively folded atop the first panel 31, such as is shown in FIG. 2. The hinge joint 34 also enables the first panel 31 and the second panel 32 to be unfolded into a coplanar configuration that forms a support platform 36, as is shown in FIG. 3.

When folded, the first panel 31 and the second panel 32 can be received within the depression 30 on the top surface 16 of the bag construct 12. As is indicated in FIG. 2, this provides the bag construct 12 with a hard, flat top, regardless of the materials used in the fabrication of the bag construct 12 or the surface contours of the bag construct 12. Accordingly, the bag construct 12 can be used to support items, such as a laptop computer or a cup of coffee without the support platform 36 being deployed. The first panel 31 and the second panel 32 can be locked into their folded configuration within the depression 30 of the bag construct 12 to prevent accidental deployment during baggage handling. When folded and locked into the depression 30, such as shown in FIG. 1, the underside 38 of the second panel 32 faces upwardly. Being positioned as such, a carry handle 40 can be provided on the underside 38 of the second panel 32 for use in carrying the overall travel bag assembly 10 in this configuration. When in the folded configuration, it is preferred that the underside 38 of the second panel 32 be flush with, or just slightly above, the top of the depression 30. As such, the depth of the depression 30 is approximately equal to the combined heights of the two panels 31, 32.

Figure 4:
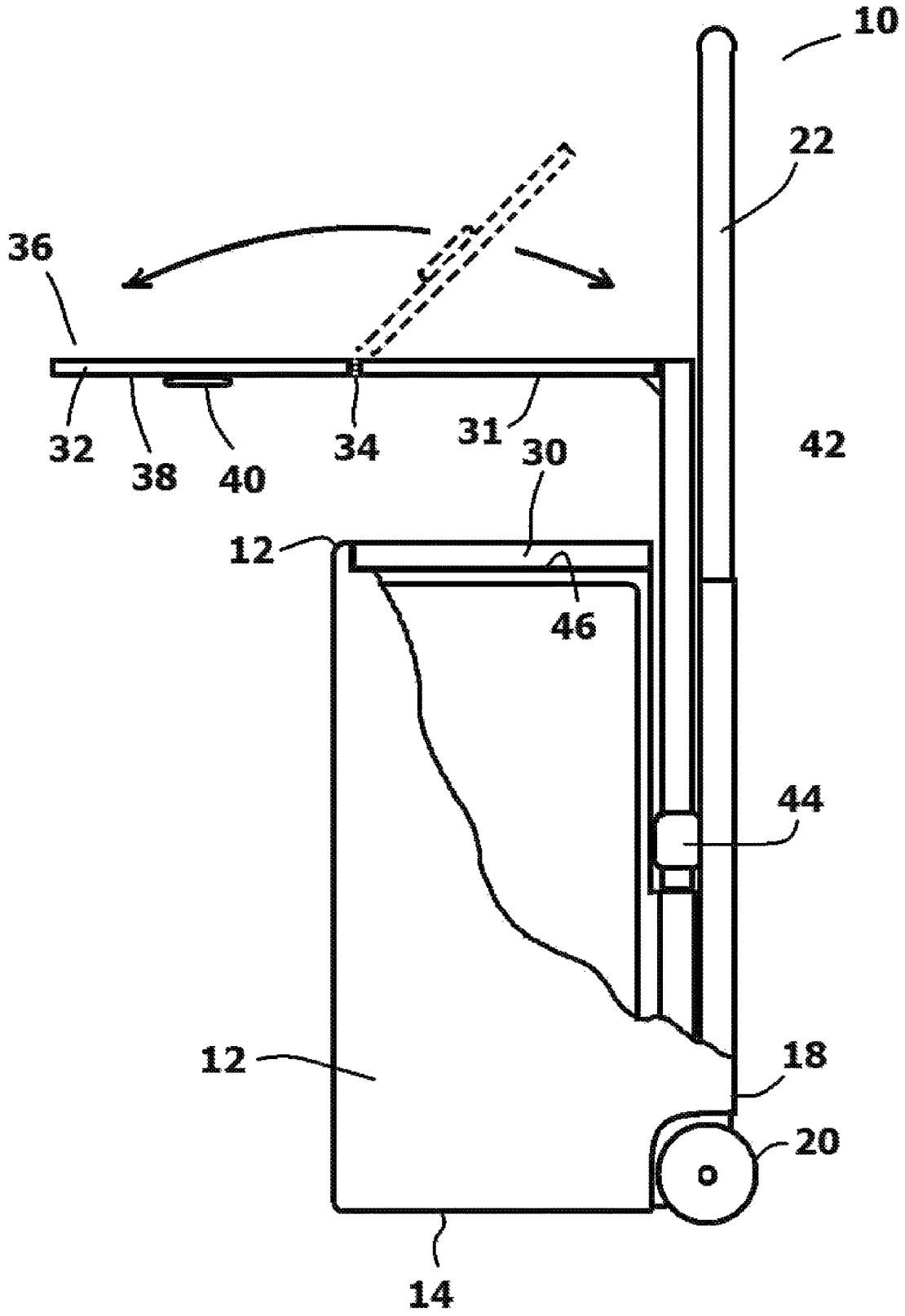
FIG. 4 is a cross-sectional view of the embodiment of FIG. 3.

Referring to FIG. 4 in conjunction with FIG. 3, it can be seen that the support platform 36 is affixed to at least one adjustable shaft 42. In the shown embodiment, only one adjustable shaft 42 is illustrated. The adjustable shaft 42 is telescoping and can be selectively adjusted in height through a range. The range depends upon the size of the bag construct 12, but typically is between six inches and twenty-four inches. The adjustable shaft 42 can be locked into different lengths using a traditional telescoping shaft locking mechanism 44, such as detent pins, collar locks and/or lever locks. Accordingly, it will be understood that the support platform 36 can be selectively adjusted in height by manipulating the adjustable shaft 42. The adjustments to the height of the support platform 36 are independent from the position of the retractable pull handle 22 of the travel bag assembly 10. As a consequence, the support platform 36 can be selectively adjusted to be above, below, or even with the height of the retractable pull handle 22, as desired by a user. In this manner, a user can adjust the retractable pull handle 22 to a point of convenience above, below, or even with the support platform 36. This enables the support platform 36 to securely hold a wider number of objects. Furthermore, objects can be placed on the support platform 36 and the retractable pull 22 handle can be independently adjusted and used to move the overall travel bag assembly 10 without disruption to the support platform 36.

From FIG. 3 and FIG. 4, it will be further understood that when the support platform 36 is elevated and deployed, the depression 30 stands open at some distance below the support platform 36. The depression 30 has a flat bottom surface 46 and side walls 48. As such, when the support platform 36 is elevated, both the support platform 36 and the depression 30 can be used to hold objects, such as pens and eyeglasses that would otherwise fall from the travel bag assembly 10 when tilted by the pull handle 22.

In use, a person can open the bag construct 12 and fill it with anything they wish to transport. The overall travel bag assembly 10 can then be wheeled to a desired location. During travel, the support platform 36 can be locked in its retracted position within the depression 30 at the top of the bag construct 12. When needed, the support platform 36 can be lifted out of the depression and extended to a desired height by extending the adjustable shaft 42. The support platform 36 can then be unfolded into its open configuration. Objects can then be placed on the support platform 36 for convenient use.

Figure 5:
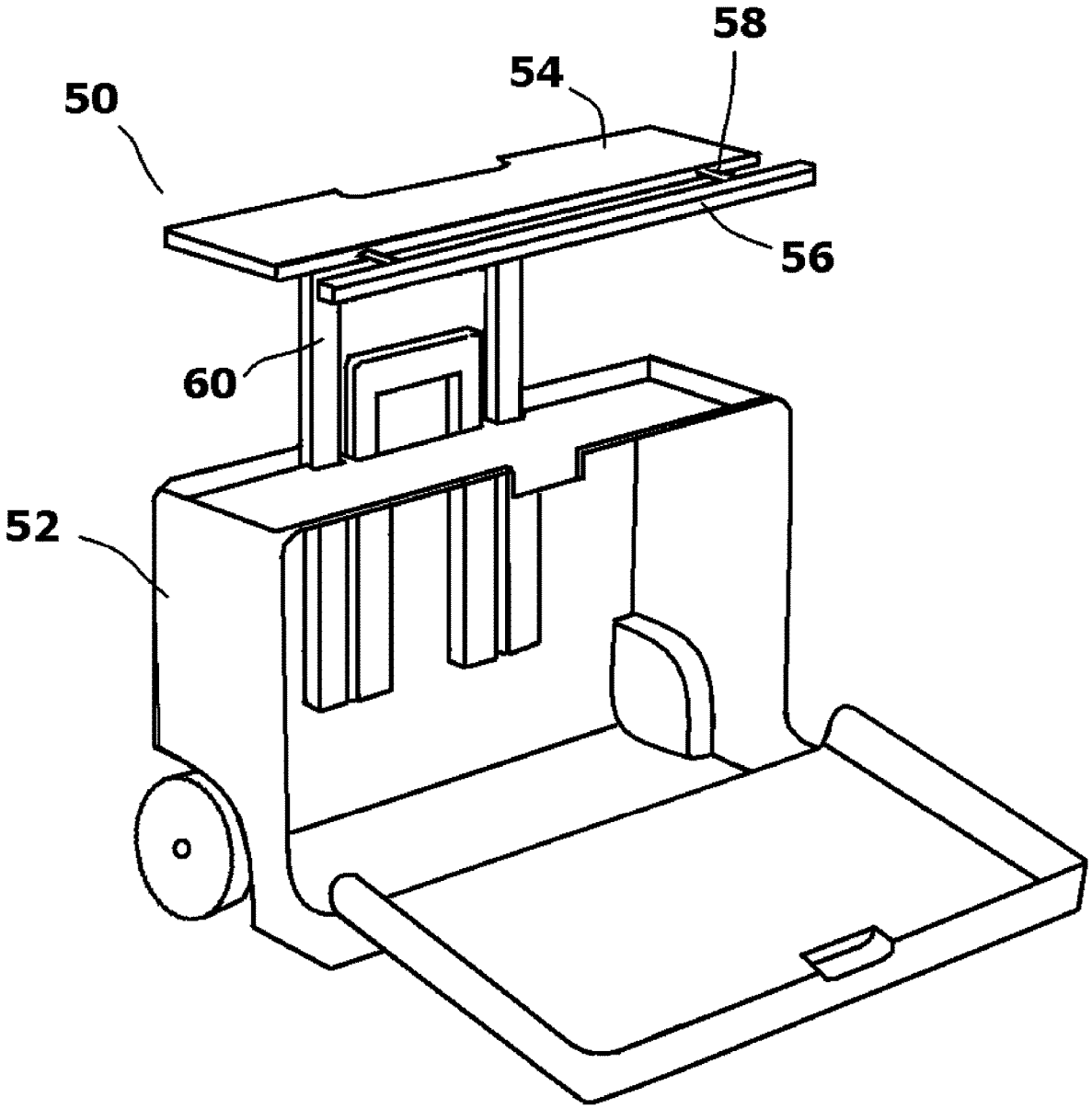
FIG. 5 is a perspective view of an alternate exemplary embodiment of a travel bag assembly.

Referring to FIG. 5, an alternate embodiment of a travel bag assembly 50 is shown. In this embodiment, there is a large bag construct 52. As such, a support platform 54 can be used that does not fold. Rather, the support platform 54 can be a single panel, or a segmented panel with sections 56 that can be laterally extended using lateral guides 58.

The support platform 54 sits in a depression 30 that mimics the shape of the support platform 54. Since the support platform 54 is large and is mounted to a larger bag construct 12, the support platform 54 is supported by two adjustable telescoping shafts 60. This provides the larger support platform 54 with increased support strength and stability. In this manner, the support platform 54 can be made strong enough to act as a seat as well as a support platform for secondary objects.

It will be understood that the embodiments of the present invention that are illustrated and described are merely exemplary and that a person skilled in the art can make many variations to those embodiments. For instance, the size, shape and model of the bag construct can be changed to accommodate different needs. Likewise, the support platform can have a wide variety of shapes. All such embodiments are intended to be included within the scope of the present invention as defined by the claims.

What is claimed is:

1. A travel bag assembly, comprising:

a bag construct having a bottom surface, an opposite top surface, and an interior;

wheels that extend below said bottom surface;

a retractable pull handle extending from said bag construct that can be selectively extended to a height above said top surface;

a depression formed into said top surface of said bag construct, said depression having a peripheral shape with a flat base surface and side walls, wherein said depression is isolated from said interior of said bag;

a support platform having at least one panel that fits into said depression; and at least one adjustable telescoping shaft that connects said support platform to said bag construct, wherein said at least one adjustable telescoping shaft enables said support platform to be selectively vertically adjusted from a first position within said depression to a second position vertically above said depression without adjusting said retractable pull handle, wherein said at least one adjustable telescoping shaft solely supports said support platform when elevated above said top surface of said bag construct.

2. The assembly according to claim 1, wherein said range includes a first position, wherein at least part of said support platform seats within said depression.

3. The assembly according to claim 1, wherein said support platform includes a first panel and a second panel that are joined with a hinge joint that enables said second panel to be selectively folded onto said first panel, wherein said second panel has an underside that faces away from said bag construct when folded over said first panel.

4. The assembly according to claim 3, wherein said first panel has a shape that mimics said peripheral shape of said depression.

5. The assembly according to claim 3, wherein said first panel and said second panel have mirror image shapes.

6. The assembly according to claim 3, wherein a carry handle is affixed to said underside of said second panel.

7. A travel bag assembly, comprising:

a bag construct having a depression formed on a surface thereof;

a support platform having a first panel and a second panel that are joined with a hinge joint that enables said second panel to be selectively folded onto said first panel, wherein said first panel is configured to rest within said depression, wherein said second panel has an underside that faces away from said bag construct when folded over said first panel;

a carry handle is affixed to said underside of said second panel;

at least one adjustable shaft that connects said support platform to said bag construct, wherein said at least one adjustable shaft enables said support platform to be selectively adjusted throughout a range that extends from a first position within said depression to a second position at an elevation above said depression; and a retractable pull handle extending from said bag construct that is separate and distinct from said at least one adjustable shaft.

8. The assembly according to claim 7, wherein said depression has a peripheral shape and first panel has a shape that mimics said peripheral shape.

9. The assembly according to claim 7, wherein said first panel and said second panel have mirror image shapes.

10. A travel bag assembly, comprising:

a bag construct having top surface, and an interior;

a depression formed in said top surface thereof, wherein said depression has a flat bottom surface of a peripheral shape and wherein said depression is isolated from said interior of said bag;

a first support panel that shares said peripheral shape and is configured to rest within said depression;

a second support panel that is attached to said first support panel, wherein said second support panel can be selectively folded atop said first panel from a coplanar position, wherein said second panel has an underside that faces away from said bag construct when folded atop said first panel;

a handle for lifting said bag construct affixed to said underside of said second panel; and at least one adjustable shaft that connects said first support panel to said bag construct, wherein said at least one adjustable shaft enables said support platform to be selectively adjusted throughout a range that extends from a first position within said depression to a second position at an elevation above said depression.

11. The assembly according to claim 10, further including a retractable handle extending from said bag construct that is separate and distinct from said at least one adjustable shaft.

12. The assembly according to claim 10, wherein said second support panel that is attached to said first support panel with a hinged joint that enables said second support panel to be folded atop said first support panel.

13. The assembly according to claim 12, wherein said second support panel shares said peripheral shape and is configured to rest within said depression.

* * * * *